US007073297B2

(12) United States Patent
Grinstead

(10) Patent No.: US 7,073,297 B2
(45) **Date of Patent: *Jul. 11, 2006**

(54) COMPONENT AND METHOD FOR RESTORING A STAIRWAY

(75) Inventor: John D. Grinstead, Durham, NC (US)

(73) Assignee: J. D. Grinstead General Construction Company, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/130,679

(22) Filed: May 17, 2005

(65) Prior Publication Data

US 2005/0210775 A1 Sep. 29, 2005

Related U.S. Application Data

(63) Continuation-in-part of application No. 10/453,026, filed on Jun. 3, 2003, now Pat. No. 6,895,717.

(51) Int. Cl.
*E04F 11/00* (2006.01)

(52) U.S. Cl. ..... 52/182; 52/188; 52/191

(58) Field of Classification Search ..... 52/182, 52/188, 191, 309.9, 741.2; 182/93
See application file for complete search history.

(56) References Cited

U.S. PATENT DOCUMENTS

| | | | | |
|---|---|---|---|---|
| 888,884 | A | 5/1908 | Grossman | |
| 1,046,165 | A | 12/1912 | Farch | |
| 2,193,146 | A | 3/1940 | Skeel et al. | |
| 3,789,556 | A | 2/1974 | Skinner | |
| 3,978,628 | A | 9/1976 | Turner | |
| 4,034,525 | A | 7/1977 | Yokomori | |
| 4,343,120 | A | 8/1982 | Witte | |
| 4,899,504 | A | 2/1990 | Hirschhorn | |
| 5,014,475 | A | 5/1991 | Anderson et al. | |
| D389,588 | S | 1/1998 | Dunk | |
| 5,794,391 | A | 8/1998 | Howard | |
| 5,799,448 | A | 9/1998 | Dunk | |
| 6,895,717 | B1 * | 5/2005 | Grinstead | 52/182 |

FOREIGN PATENT DOCUMENTS

JP 2000120243 A * 4/2000

* cited by examiner

*Primary Examiner*—Kimberly Wood
(74) *Attorney, Agent, or Firm*—Olive & Olive, P.A.

(57) ABSTRACT

A fiberglass molded stairway component and method of using the component enables an old stairway to be removed and replaced by a new stairway while making reuse of the existing stringers and using new stair supports or stair supports previously used with the stairway being replaced.

8 Claims, 1 Drawing Sheet

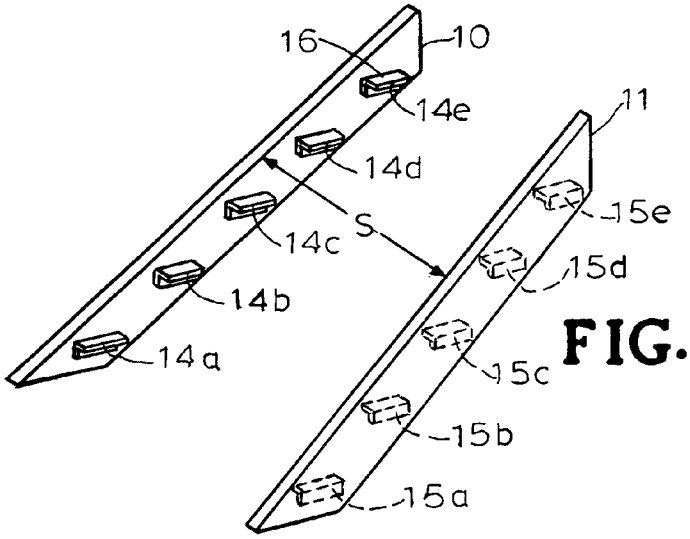
FIG. 1
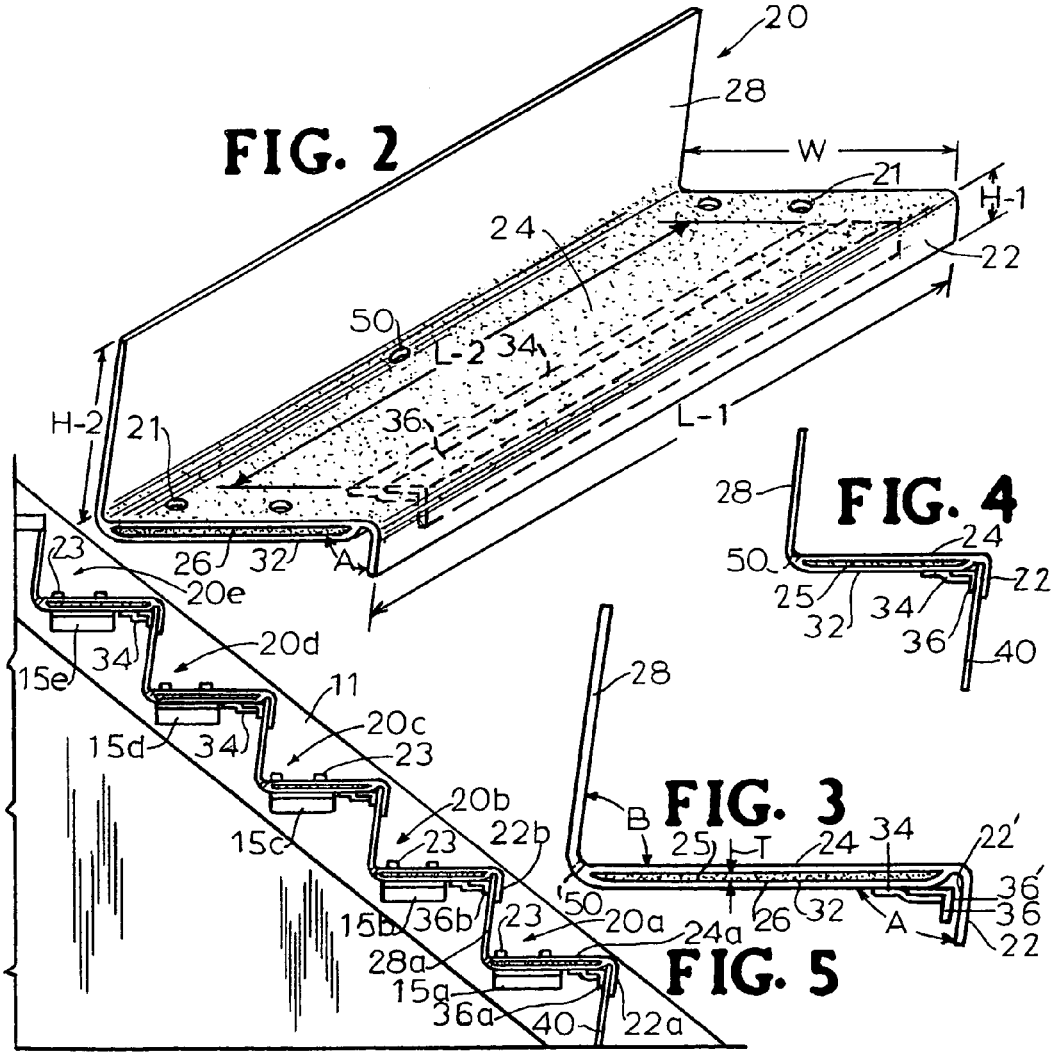
FIG. 2
FIG. 4
FIG. 3
FIG. 5

COMPONENT AND METHOD FOR RESTORING A STAIRWAY

This is a continuation-in-part of commonly assigned U.S. patent application Ser. No. 10/453,026 filed Jun. 3, 2003 now U.S. Pat. No. 6,895,717.

BACKGROUND OF THE INVENTION

Building contractors and others involved with replacing old stairways and building new stairways are constantly searching for ways by which to restore old and build new stairways. One situation that continues to repeat itself is that when an old stairway is removed, it is often the case that the metal or wood stringers can be reused, whereas the step supports, typically in the form of short pieces of right-angle metal strips fastened to the inside surfaces of the stringers, are in most cases replaced but in other cases are left in place for reuse. Thus, there is a need for being able to use existing stringers and either new or existing stair supports when a stairway is being replaced in a building. One purpose of the invention thus becomes that of providing a component and method useful for restoring a stairway on existing stringers and on either new or existing stair supports.

The component and method of the invention, while primarily directed to use in conjunction with replacing old stairways, also finds application to the practice of building new stairways. In either case, the invention further recognizes the advantages of being able to either restore an old stairway or build a new stairway by use of relatively light weight, easily handled components that can be put together at the job site to build a stairway without the need for having to pour concrete to form steps, having to weld parts together, or having to use a crane to assist in building the stairway from a heavy assembly or heavy components as in many prior art practices. Furthermore, the invention provides for quick assembly, which is highly useful when restoring a stairway in a residential setting.

Recognizing that the invention is directed to a component, which can be joined to other components of similar construction for the purpose of building either a replacement or new stairway, reference is next made to the following United States patents as being representative of known types of stairway components, which can be put together at the job site in order to build a replacement or new stairway, namely U.S. Pat. Nos. 2,193,146; 4,034,525; 4,343,120; 4,899,504; 5,794,391; 5,799,448; and Des. 389,588.

Another aspect of prior practices associated with the construction of stairways is the practice of installing a pan at the site of each step and filling the pan with concrete to form each individual step. U.S. Pat. No. 4,899,504 cited above illustrates this practice. In another practice illustrated by U.S. Pat. No. 2,193,146, the parts of the stairway are welded together at the job site to form an assembled stairway.

Another problem faced by those who construct new stairways on existing stringers is the fact that the spacing between the stringers will vary due to settling, misaligned building components, warping, and the like. Thus, the invention recognizes that the easily cut stairway component of the invention when cut to length at the site can be made to accommodate and adjust to different stringer spacings.

So far as is presently known, the prior art has not provided a component and method for restoring a stairway, and which are specifically adapted to make use of existing stringers, make use of either new or existing stair supports, and accommodate to varying space between the stringers.

With the above in mind, a principal object of the present invention is to provide a relatively light weight, relatively strong, self-supporting, ready-to-use, cut-to-length stairway component, which can be quickly installed on existing stringers having sets of either newly-installed or previously-installed stair supports on the interior faces thereof and engaged with portions of other components of similar construction to form a complete stairway and in a manner that accommodates to different spacings between existing stringers, that requires no welding at the job site to complete construction of the component or addition of concrete to form a step on the component. Other objects will become apparent as the description proceeds.

SUMMARY OF THE INVENTION

The invention comprises a unitary molded component, which in conjunction with other similarly-formed and interengaging components having a later-discussed reinforcing fiberglass guide strip, can be cut to a length appropriate to the spacing between the stringers, dropped in place at the job site, secured to new or existing stair supports, and thereby form a replacement stairway supported on a set of existing stringers and either new or existing stair supports. Essentially, the entire structure of the component is formed as an integral, easily cut, molded structure, preferably of fiberglass or a composite material. Each component includes, as part of the integral structure, a back riser of a height equal to the rise of the stairway, a stair tread of appropriate size, a front riser of relatively short height arranged such that in the completed stairway, the front riser of one component overlaps the back riser of a lower component, and a right-angle shaped guide strip secured to the bottom surface of the stair tread and spaced rearwardly of the front riser.

BRIEF DESCRIPTION OF THE DRAWINGS

FIG. 1 illustrates, in a perspective view, a typical set of previously-used stringers having attached short right-angle stair support strips on the interior faces thereof and suited for receiving interengaged components of the invention so as to construct a replacement stairway.

FIG. 2 is a perspective view of the stairway component of the invention with its stair tread and right angle guide strip shown hidden.

FIG. 3 is an end view of the component shown in FIG. 2 with an end view of the right-angle guide strip and completed stair tread.

FIG. 4 is an end view of reduced size similar to that of FIG. 3 but showing the upper edge of the back riser of a lower component positioned between the front riser of an upper component and its guide strip.

FIG. 5 is an end view of a completed stairway indicated as being supported on one of the stringers of FIG. 1 and secured to its associated right-angle stair support strips.

DETAILED DESCRIPTION

As previously mentioned, the component and method of the invention, while adapted to building new stairways, are primarily intended to serve the needs of construction companies who renovate old buildings and, in the course of such renovation, find it necessary to replace old stairways. In this type of renovation, the contractor doing the work frequently finds it possible to remove the old stairway but leave in place the stringers and also in some cases leave in place the stair supports attached to the stringers. In this regard, FIG. 1 illustrates a typical set of stringers 10, 11 with interior sides spaced apart by a distance S. Also shown in FIG. 1 is a typical set of short right-angle support strips 14*a*, 14*b*, 14*c*, 14*d*, and 14*e* secured to the interior side of stringer 10 and a set of right-angle support strips 15*a*, 15*b*, 15*c*, 15*d*, and 15*e* secured to the interior side of stringer 11. The stringers, as well as the support strips, are typically made of metal, though they may be made of wood or other materials.

The unassembled stairway component 20 of the invention is designed with a common length L-1 (FIG. 2), of, for example, about 45 inches or such length as is substantially equal to the maximum anticipated space S. This permits the component 20 to be cut to a length corresponding to the space S where the component is being installed so as to rest in a snug fit within the space S (FIG. 1) on the ledges 16 (FIG. 1) provided by the support strips 14*a*–14*e* and 15*a*–15*e*. As best seen in FIGS. 2 and 3, the component 20 basically comprises an integral molded structure preferably formed of a molded high-strength fiberglass or composite material and providing a front riser rectangular panel 22 having a length L-1 of, for example, 45 inches, and a relatively short height H-1 of, for example, 2 inches. Each component 20 further includes a rectangular stair tread panel 24 having a width W suited to the width of the desired stair tread, for example 10½ inches, and a rectangular back riser panel 28 of length L-1, 45 inches, and of a height H-2 of, for example, about 7 inches. Front riser 22 is bent at an angle A (FIG. 3) of slightly less than 90° with respect to the stair tread panel 24 and back riser panel 28 is bent at an angle B (FIG. 3) of slightly less than 90° with respect to the plane of stair tread panel 24.

Affixed to the bottom surface 32 of stair tread panel 24 by means of an adhesively-secured fiberglass tape 34 (FIG. 3) and spaced slightly rearwardly of the inner surface of front riser 22 is a right-angle formed fiberglass guide strip 36 (FIG. 3), which extends for a length L-2 (FIG. 2) comprising a major portion of the length L-1 of the component 20 as depicted in dashed lines in FIG. 2, but without interference with the respective pair of support strips, on which each particular component 20 is mounted.

Each component 20 is formed with a nondegradeable foam material 26 (FIG. 2) of approximately ⅜ inch thickness T (FIG. 3) affixed to the bottom surface of its stair tread panel 24. This material, once covered, in effect, establishes a core 25 (FIG. 3) below stair tread panel 24. Once in place, foam material 26 is covered over as indicated at the bottom surface 32 by consecutively applied layers of the high strength fiberglass or composite material, of which the component is formed. Panels 24 and 32 on opposite sides of the core 25, by reason of being separated by the thickness of the core material 26, effectively form a stiffening beam extending for the entire length L-1. This construction thus gives rigidity and strengthening to the completed stairway. A skid resistant coating is applied to stair tread panel 24. An example of the skid resistant coating is an epoxy-based paint rolled on in the final stage of forming stair tread panel 24.

In making use of component 20, the lowermost component 20*a* (FIG. 5) is cut to a length corresponding to the spacing S at the location where such component is being installed. An adhesive is next applied between the surface 36' (FIG. 3) on guide strip 36 and opposite surface 22' on front riser 22 of this lowermost component 20*a* (FIG. 5). A kick-plate 40 is then inserted as in FIG. 4 such that its top edge is trapped between the guide strip 36 and front riser 22 of the lowermost component 20*a*. Shallow pilot holes 21 are formed on stair tread panel 24*a* (FIG. 2) of this component 20*a* corresponding to the spacing S between the stringers at the location at which component 20*a* is being installed after which such component is secured by screws 23 or the like to the respective right angle support strips 14*a*, 15*a* seen in FIG. 1, and which, as previously explained, may in some instances be new and in other instances may be existing. The next component 20*b* is then cut to its appropriate length and in a similar manner is installed with its front riser 22*b* overlapping the back riser 28*a* of component 20*a* and is located between front riser 22*b* of component 20*b* and guide strip 36*b* of component 20*b*. The remaining components 20*c*, 20*d*, and 20*e* are assembled in a similar manner to provide a complete stairway as shown in FIG. 5.

Each component 20 (20*a*–20*e*) contains a drain aperture 50, seen in FIG. 2–FIG. 5 to allow fluids to pass through from the top side of the component to the underside. In the completed stairway, this would allow for fluids such as rainwater to drain through aperture 50 preventing a potentially unsafe puddle of water from forming on the stair tread. In the preferred embodiment, a single hole is used, however, as those skilled in the art can appreciate, component 20 may contain a plurality of apertures if desired. Aperture 50 can be of any desired diameter such as one-eighth or one-half of an inch, but preferably one-quarter of an inch. Aperture 50 is preferably located on stair tread panel 24 where the back riser 28 joins stair tread panel 24, as shown in FIG. 2, but may be located anywhere on stair tread panel 24.

As can be seen from the foregoing description, it now becomes possible to reuse previously-installed stringers and either new or used stair supports and in a manner that accommodates to differences in spacing between the stringers, does not require use of added concrete for forming steps, welding for joining parts, crane lifting of heavy parts, or supplemental bracing or stiffening of the stair treads for added strength. Further, the reconstruction of a stairway can be accomplished quickly in residential applications, minimizing disruption to residents.

I claim:

1. An integrally formed stair component adapted when a forward portion thereof is placed on a rearward portion of a second component of similar construction for forming a stairway by being secured to and supported on uniformly vertically spaced ledges extending inwardly from the inside faces of a pair of uniformly spaced apart, upwardly and rearwardly angled stair stringers, comprising:

a) a first portion formed of fiberglass in an integral molded easily cut structure, comprising:

i) a substantially vertically disposed rectangular panel forming a back riser;

ii) a substantially horizontally disposed rectangular panel forming a stair tread having a lengthwise extending rear edge joined to a lengthwise extending bottom edge of said back riser, said stair tread extending forwardly of and substantially perpendicular to said back riser;

iii) a substantially vertically disposed rectangular panel forming a front riser having a lengthwise extending top edge joined to a lengthwise extending front edge of said stair tread, said front riser extending downwardly from and substantially perpendicular to said stair tread;

iv) a drain aperture extending through the thickness of said stair tread and located intermediate the length of and between the said rear and front edges of said tread, said aperture providing a substantially vertical path of drainage for said stair tread laterally offset from the path of drainage formed by apertures in stair components of similar construction located above and below said stair tread;

v) the length of said back riser, stair tread, and front riser panels being of a substantially uniform dimension substantially corresponding to the spacing between the said inside faces of said stringers at the location at which said component is being installed, the height of said back riser panel being of a substantially uniform dimension that substantially corresponds to the riser height of the stairway utilizing said component, the height of said front riser panel being of a substantially uniform dimension that is less than the height of said back riser panel but sufficient to provide a selected amount of overlap of said front riser panel over a minor upper portion of a back riser panel of said second component located below said stair tread panel, and said back riser panel, stair tread panel, and front riser panel of each said component being configured such that said stair component can be mounted on said second component in a manner which enables the front riser panel of the said stair component to overlap by said selected amount an upper portion of the back riser panel of said second component; and (vi) said stair tread panel being molded so as to include on a bottom surface thereof a strengthening member comprising a layered fiberglass covered core and whose width and length substantially corresponds to the width and length of said stair tread panel; and b) a second portion comprising a guide strip of right-angle, cross-sectional and easily cut form being mounted on the bottom surface of said stair tread panel within the juncture of said stair tread panel and front riser panel and rearwardly of the inner surface of said front riser panel in a manner adapted to form a recess adapted to receive and locate an entering top edge of the back riser panel of said second component located below the component mounting said guide strip.

2. An integrally formed stair component as claimed in claim 1, wherein the upper surface of said stair tread panel is formed as a skid resistant surface and said aperture extends through said skid resistant surface.

3. An integrally formed stair component as claimed in claim 1, wherein said core comprises a foam core and said aperture extends through said foam core.

4. An integrally formed stair component as claimed in claim 1, further comprising a plurality of apertures.

5. A method for creating a stairway comprising the steps of:

a) installing or, if already in place, preparing for use at the site of the stairway a pair of uniformly spaced-apart, upwardly and rearwardly angled stair stringers fitted with uniformly vertically spaced ledges located according to the riser height of said stairway and extending inwardly from the inside faces of said stringers;

b) forming a plurality of stair components suited for support on said ledges, and each of which comprises:

aa) a first portion formed of fiberglass in an integral molded easily cut structure, comprising:

i) a substantially vertically disposed rectangular panel forming a back riser;

ii) a substantially horizontally disposed rectangular panel forming a stair tread having a lengthwise extending rear edge joined to a lengthwise extending bottom edge of said back riser panel, said stair tread panel extending forwardly of and substantially perpendicular to said back riser panel;

iii) a substantially vertically disposed rectangular panel forming a front riser having a lengthwise extending top edge joined to a lengthwise extending front edge of said stair tread panel, said front riser panel extending downwardly from and substantially perpendicular to said stair tread panel;

iv) an aperture providing a drain aperture extending through the thickness of said stair tread and located intermediate the length of and between the said rear and front edges of said tread, said aperture providing a substantially vertical path of drainage for said stair tread laterally offset from the path of drainage formed on stair components of similar construction when located above and below said stair tread;

v) the length of said back riser, stair tread, and front riser panels being of a substantially uniform dimension, which after being cut to length substantially corresponds to the spacing between the said inside faces of said stringers at the location at which said component is installed, the height of said back riser panel being of a substantially uniform dimension that substantially corresponds to the riser height of the stairway utilizing said component, the height of said front riser being of a substantially uniform dimension that is less than the height of said back riser panel but sufficient to provide a selected amount of overlap of the front riser panel over a minor upper portion of a back riser panel of a second said component located below the stair tread panel of said first component, and said back riser, stair tread, and front riser panels of each said component being configured such that a first said component can be mounted on a second said component in a manner which enables the front riser panel of the said first component to overlap by said selected amount a minor upper portion of the back riser panel of said second component; and (vi) said stair tread panel being molded so as to include on a bottom surface thereof a strengthening member comprising a layered fiberglass covered core and whose width and length substantially corresponds to the width and length of said stair tread panel; and bb) a second portion comprising a guide strip of right-angle, cross-sectional and easily-cut form and mounted on the bottom surface of said stair tread panel within the juncture of said stair tread and front riser panels in a manner adapted to form a recess adapted to receive and locate an entering top edge of the back riser panel of a component below the component mounting said guide strip;

c) locating on respective pairs of ledges each of a series of said components after being cut to a length corresponding to the spacing of the stringers at the location of said components and in a manner such that the front riser of each said component is made to overlap a selected minor upper portion of the back riser panel of the next lower component; and d) securing the stair tread panel of each said component to the pair of said ledges on which said component rests.

6. The method of claim 5, wherein the upper surface of said stair tread panel is formed as a skid-resistant surface and said aperture extends through said skid resistant surface.

7. The method of claim 5, wherein said core comprises a plastic foam core and said aperture extends through said plastic foam core.

8. The method of claim 5, wherein said stair component further comprises a plurality of apertures.

* * * * *